United States Patent [19]

Anderson

[11] 4,195,808

[45] Apr. 1, 1980

[54] COMBINATION MOUNTING BRACKET AND SUPPORT PIPE

[75] Inventor: Melvin R. Anderson, Avon Lake, Ohio

[73] Assignee: Westinghouse Electric Corp., Pittsburgh, Pa.

[21] Appl. No.: 941,612

[22] Filed: Sep. 12, 1978

[51] Int. Cl.[2] ..... E04G 3/00

[52] U.S. Cl. ..... 248/219.1; 52/697; 362/431

[58] Field of Search ..... 248/219.1, 219.3; 52/697, 721, 28, 40; 174/45 R; 362/431

[56] References Cited

U.S. PATENT DOCUMENTS

| | | | |
|---|---|---|---|
| 2,540,784 | 2/1951 | Hocher | 248/219.1 |
| 2,696,357 | 12/1954 | Elmer | 248/219.3 X |
| 2,750,142 | 6/1956 | McKee | 248/219.1 X |
| 2,907,543 | 10/1959 | Heinzen | 248/219.1 |
| 3,050,620 | 8/1962 | Schlosser et al. | 362/431 |
| 3,243,152 | 3/1966 | Harling | 248/219.3 |
| 3,317,170 | 5/1967 | Pfaff | 248/219.3 |
| 3,408,028 | 10/1968 | Raymond | 248/219.3 |
| 3,494,584 | 2/1970 | Dubey | 174/158 R X |
| 3,975,580 | 8/1976 | Lewis | 248/219.3 X |

*Primary Examiner*—J. Franklin Foss
*Attorney, Agent, or Firm*—B. R. Studebaker

[57] ABSTRACT

A combination mounting bracket and support pipe for mounting a luminaire or the like to a vertical pole is disclosed. The combination mounting bracket and support pipe includes a curved tubular support pipe having an elongated slot in one end thereof which slips over the head of a thru-bolt extending through the vertical pole. A U-shaped clamp is welded to the support pipe above the elongated slot and secures the combination to the pole by a pair of lag screws which extend through the clamp and into the pole.

2 Claims, 5 Drawing Figures

COMBINATION MOUNTING BRACKET AND SUPPORT PIPE

BACKGROUND OF THE INVENTION

The combination mounting bracket and support pipe of this invention is particularly adapted for the mounting of lighting fixtures or luminaires to utility poles and the like. As in almost every area of modern technology, pressures are being brought to bear upon manufacturers to reduce the cost of materials and manufacturing processes in producing their products without a complementary sacrifice in that product's integrity and performance from a technical standpoint. In a situation where, as here, a street lighting luminaire or the like must be supported above an area where pedestrian and vehicular traffic is continually passing, cost reducing improvements cannot jeopardize product safety factors.

To support a luminaire to a utility pole, a curved or L-shaped support pipe is generally employed with the opposite ends of the pipe being directed at approximately 90° from each other. Several prior art mounting brackets for mounting the support pipe to a vertical utility pole or the like are well known and have been extensively used for this purpose. One early mounting bracket, still in use today, is disclosed in U.S. Pat. No. 2,608,369 issued Aug. 26, 1952 to A. A. Hocher. The Hocher bracket involves the welding of two separate mounting brackets to the support pipe with the upper bracket being substantially U-shaped with the arms welded to the support pipe and the base portion including a slot therein which slips over a thru-bolt extending through the post. A second strap, also welded to the support pipe, includes a pair of wing portions having apertures therethrough to accommodate lag bolts to complete the mounting of the support pipe to the vertical pole. In the Hocher configuration two separate spaced bracket members must be welded to the support pipe. Another commonly used support bracket is disclosed in U.S. Pat. No. 3,408,028 issued Oct. 29, 1968 to M. H. Raymond. In the Raymond bracket, a generally C-shaped portion forms a socket into which the support pipe is received. The C-shaped portion has extending therefrom spaced parallel arms which project outwardly from the open side of the C-shaped portion and extend into arcuate plate portions for securing the clamp to the pole. The head of a thru-bolt extending through the vertical pole is captured between the spaced parallel arms while a clamping bolt secures the two parallel arms together and is used to draw the spaced parallel arms toward each other, thereby clamping the support pipe therein. The Raymond bracket, although working quite well to mount a support pipe, involves a particularly expensive construction with the addition of the tightening bolt and spacer member.

SUMMARY OF THE INVENTION

The combination support pipe and mounting bracket of this invention significantly reduces the amount of material required and the number of welding operations, as well as the amount of associated hardware necessary as compared to prior art mounting brackets. The mounting bracket and support pipe combination of this invention for mounting luminaires or the like to vertical poles employs a substantially U-shaped clamp having laterally extending arcuate flanges thereon welded to an L-shaped tubular support pipe, which support pipe has an elongated slot therein at one end thereof which slips over the head of an elongated thru-bolt extending through the vertical pole to which the support pipe is to be mounted. The U-shaped clamp member includes laterally extending arcuate flanges which firmly secure the support bracket to the vertical post by means of lag screws or the like.

BRIEF DESCRIPTION OF THE DRAWINGS

Many of the attendant advantages of the present invention will become more readily apparent and better understood as the following detailed description is considered in connection with the accompanying drawings in which.

DESCRIPTION OF THE PREFERRED EMBODIMENT

Figure 1:
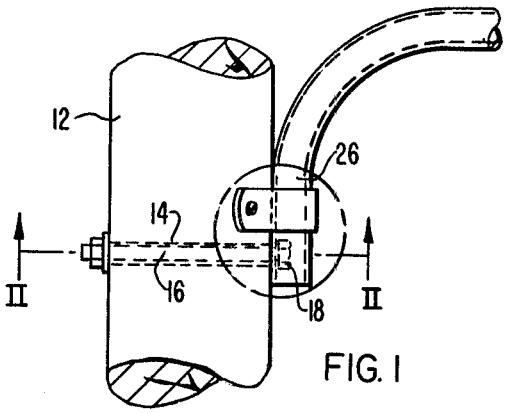
FIG. 1 is a side elevational view of the combination support pipe and mounting bracket of this invention mounted to a vertical post.
Figure 3:
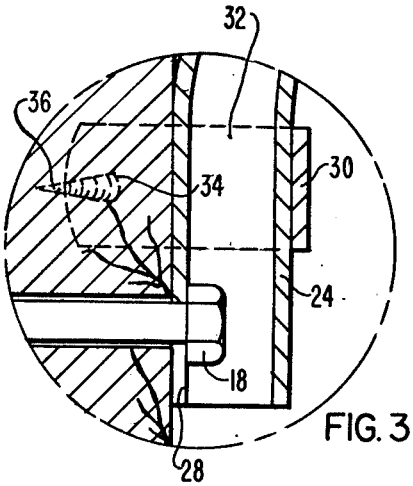
FIG. 3 is an exploded sectional view of the circled area of FIG. 1.
Figure 2:
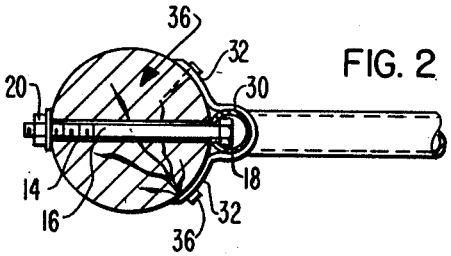
FIG. 2 is a sectional view taken along the line II—II of FIG. 1.
Figure 4:
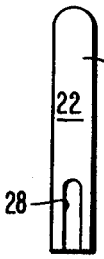
FIG. 4 is a rear elevational view of the support pipe.
Figure 5:
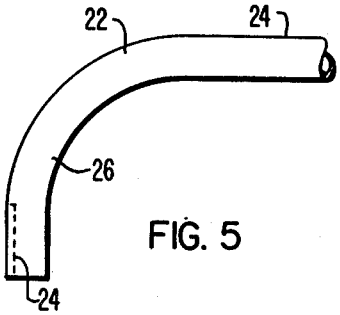
FIG. 5 is a side elevational view of the support pipe.

Referring now in detail to the drawings wherein like reference characters represent like parts throughout the several views, there is illustrated in FIG. 1 a typical vertical pole 12, such as, for example, a wooden utility pole which includes an aperture 14 drilled therethrough to accommodate a thru-bolt 16 having a head 18 thereon. The thru-bolt 16 may be drawn up and tightened by means of a nut 20 on the end thereof opposite the mounting bracket of this invention. A curved or L-shaped support pipe 22 includes a longer leg 24 for connection to a luminaire or the like and a shorter leg 26 for securing the support pipe to the vertical pole 12. The support pipe 22 also includes an elongated slot 28 therein which extends from the end edge of the shorter leg 26 in a direction parallel to and adjacent the vertical pole 12. Welded to the shorter leg 26 of the support pipe on the opposite side from and just above the top edge of the slot 28 is a U-shaped clamp 30 having a pair of arcuate flanges 32 extending therefrom. Each of the arcuate flanges 32 has apertures 34 therethrough to accommodate lag screws 36 or the like for securing the support pipe to the vertical post.

In operation, when it is desired to mount a lighting fixture or the like to a utility pole, a hole is first drilled through the utility pole to accommodate the thru-bolt 16, which is conventional to most bracket systems. In accordance with the present invention, the support pipe 22 carrying the U-shaped flange 30 welded thereto simply requires that the elongated slot 28 be slipped over the head 18 of the thru-bol 16 and held momentarily while lag screws 36 are driven through the apertures 34 in the arcuate flanges 32. To complete the installation, the nut 20 on the thru-bolt 16 is tightened and the task of mounting the luminarire to the utility pole is simply and effectively completed.

As will be apparent from the foregoing, the combination mounting bracket and support pipe of this invention is simple in operation and substantially reduces the amount of material required in the bracket itself while also reducing the welding operations required in the manufacture of the combination as compared with the prior art devices.

What is claimed is:

1. A combination mounting bracket and support pipe for mounting a luminaire or the like to a vertical pole, said combination mounting bracket and support pipe comprising:

a curved tubular support pipe including a shorter leg and a longer leg, said shorter leg having an elongated slot extending from its end edge in a direction parallel to the axis thereof;

an elongated thru-bolt having an enlarged head thereon adapted to extend through said vertical pole, said elongated slot being constructed and arranged to slip over said thru-bolt and contain said enlarged head within said shorter leg of said tubular support pipe, and a substantially U-shaped clamp having laterally extending arcuate flanges thereon and welded to said shorter leg of said curved tubular support pipe on the opposite side from and slightly above said elongated slot for clamping said support post to said vertical pole.

2. The combination according to claim 5 wherein an aperture is located in each of said laterally extending arcuate flanges, said apertures constructed and arranged to receive lag screws for securing said support pipe to said vertical pole.

* * * * *